United States Patent [19]

Buggy

[11] 4,063,692

[45] Dec. 20, 1977

[54] WEB WINDING APPARATUS

[75] Inventor: Michael Buggy, Melrose, Mass.

[73] Assignee: Vista Developments, Inc., Melrose, Mass.

[21] Appl. No.: 695,130

[22] Filed: June 11, 1976

[51] Int. Cl.[2] ..... B65H 19/04; B65H 17/02

[52] U.S. Cl. ..... 242/56.9; 242/67.1 R; 242/75.51

[58] Field of Search ..... 242/56.9, 56.3, 56.2, 242/56.4, 67.1 R, 56.7, 58.6, 75.5, 75.51; 318/6, 7

[56] References Cited

U.S. PATENT DOCUMENTS

| | | | |
|---|---|---|---|
| 2,684,210 | 7/1954 | Conti | 242/56.9 |
| 3,603,521 | 9/1971 | Ormsby | 242/56.2 |
| 3,712,554 | 1/1973 | Lorenzini | 242/56.9 |
| 3,853,280 | 12/1974 | Pennisi | 242/56.9 |

FOREIGN PATENT DOCUMENTS

| | | | |
|---|---|---|---|
| 904,144 | 8/1962 | United Kingdom | 242/56.9 |

*Primary Examiner*—Edward J. McCarthy

*Attorney, Agent, or Firm*—Dike, Bronstein, Roberts, Cushman & Pfund

[57] ABSTRACT

In an apparatus for slitting sheet material into narrow strips and winding them onto cores, a winding shaft on which the cores are mounted, an electromagnetic clutch for clutching each core to the winding shaft and a potentiometer controlling operation of each clutch independently of the other, each clutch comprising inner and outer concentrically arranged parts, one of which is fixed to the shaft for rotation therewith and the other of which is rotatable about the one part, said parts providing axially disposed poles between which there is a working gap, a powdered magnetizable material in the gap, a coil associated with the inner part through which the current flow is controlled by the potentiometer associated therewith, and sealing means comprising nonmagnetic sealing rings at the ends of the poles for confining the magnetizable material in the working gap, said rings having opposed surfaces which converge from opposite sides of the working gap between the poles toward each other and sealing strips held engaged with the outer sides of the sealing rings.

28 Claims, 5 Drawing Figures

WEB WINDING APPARATUS

BACKGROUND OF INVENTION

Apparatus for winding a plurality of strips onto cores mounted on a common winding shaft are disclosed in the patents to Schmidt U.S. Pat. No. 3,425,395 and Ormsby U.S. Pat. No. 3,603,521. The Schmidt apparatus provides no opportunity for individual control of the clutch means and the structure disclosed therein is inherently expensive to manufacture and susceptible to breakdown. The Ormsby apparatus embodies a sophisticated control system for simultaneously adjusting the respective clutch assemblies and the speed of rotation of the winding shaft in response to signals which are proportional to the radius of the coils being wound so that it is not possible optionally to wind the strip material onto the cores at a constant tension or varying tension depending upon the width and/or thickness of material being wound. The apparatus of this invention is designed to enable employing existing slitting and winding equipment without drastic modification by employing specially designed electromagnet clutches on the drive shaft which can be controlled individually so as to enable winding strip material of different widths and varying thickness simultaneously at the same or different tensions; to provide for operating at lower winding speeds to avoid heating as the coils increase in size without change in tensions; to provide for positioning the coils at the same or different spacings along the winding shaft; and to provide for removing and remounting the cores and/or clutch assemblies on the drive shaft without major dismantling operations. The clutches are of the kind in which the torque is applied through magnetic particles confined between poles and are designed to provide for a very low starting torque if desired, an extensive range in torque, efficient transmission of the torque, minimum particle loss and minimum frictional losses and wear.

SUMMARY OF INVENTION

Apparatus for slitting sheet material into narrow strips and winding them simultaneously onto cores to form packages comprising a common driven winding shaft, a plurality of cores spaced along the shaft, means associated with each core to clutch it to the shaft and adjustable means for adjusting each clutching means independently of every other clutching means. There may be two driven shafts arranged in spaced parallel relation and cores on each of the shafts arranged to alternately receive the strips as they are divided from the sheet material. There is means common to all of the clutching means for supplying power to each of the clutches independently of any other. The clutches are electromagnetically operated, a common bus bar supported along the length of the shaft supplying current to each of the clutches and there is a potentiometer associated with each electromagnetic clutch which is mechanically adjustable to adjust the current delivered to each clutch. Each magnetic clutch comprises an inner part slidably mounted on the winding shaft for movement therealong and keyed thereto so as to be rotatable therewith, a concentric outer part rotatably mounted on the inner part and poles on the inner and outer parts with a working gap therebetween. The working gap between the poles is filled with magnetizable particles and there are means for confining the particles within the gap. The poles comprise axially spaced flanges on the inner part defining a recess in which a coil is wound for magnetizing the particles and a core on the outer part surrounding the flanges and spaced therefrom to provide a gap therebetween in which the magnetizable particles are deposited and the means for confining the particles in the gaps comprises nonmagnetizable sealing rings at the ends of the poles which have opposed surfaces which converge from opposite sides of the working gap between the poles toward each other and sealing strips held engaged with the outer sides of the sealing rings. Each core and its associated clutch is provided with means for fixing its position on the shaft and for releasing it so as to permit it to be removed from one end of the shaft and the latter can be cantilever supported to enable mounting and removing the cores and/or clutches from the one end. Current is supplied to the bus bar by a commutator mounted on the shaft having a part fixed to the shaft for rotation therewith and a rotatable part connected to a source of power. This device may be employed as a brake, or a mechanically operated clutch to restrain delivery of the sheet material to the slitting and winding means and by controlling the current as a function of OD decrease, can yield a constant tension to the web or any other tension profile desired.

The invention will now be described with reference to the accompanying drawings, wherein.

The sheet slitting and winding apparatus of this invention has in common with other sheet splitting and winding apparatus a supporting shaft or spindle 10 on which a roll of the sheet material to be split is mounted for unwinding; splitting means 12 to which the sheet material unwound from the roll of material is delivered over a guide bar 14; a pair of diversionary guide bars 16—16 beneath and over which alternate strips are drawn; and a pair of winding shafts 18—18 for winding the strips onto cores 20 mounted on the respective shafts 18—18. Gears 19—19 provide for driving the drive shafts 18—18.

Figure 1:
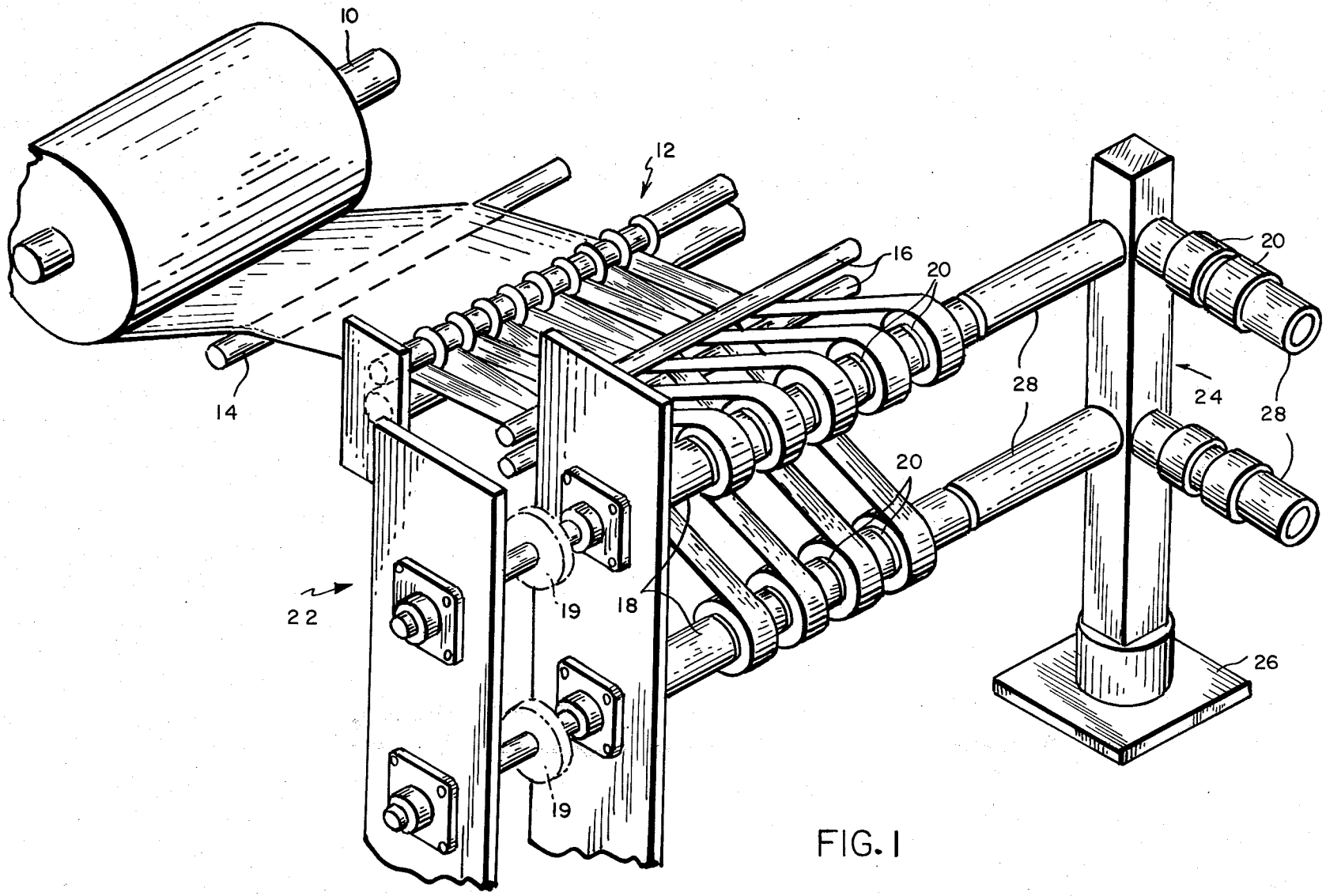
FIG. 1 is a perspective view of the sheet slitting and winding machine of this invention.

In contrast to such apparatus as is known, the winding shafts 18—18 are cantilever supported from one end on the frame of the machine indicated generally at 22, so that it is possible as will appear hereinafter to slide the cores 20 upon which the strip material is wound off of the shafts 18—18 without having to dismantle parts of the machine for this purpose. It is also to be noted that this machine is provided with a loading and unloading device 24, FIG. 1, supported for rotation about a vertical axis on a suitable base 26 adjacent the distal ends of the cantilever supported winding shafts provided with right angular disposed pairs of arms 28—28 which can be turned to dispose them opposite the distal ends of the shafts 18—18, thus enabling the operator to slide the filled cores from the shafts 18—18 onto one pair of arms 28—28, turn them to the lateral position and, in doing so, move the other pair of arms 28—28 to a position adjacent the distal ends of the shafts 18—18 so that empty cores 20 may be slid onto the shafts 18—18.

Figure 2:
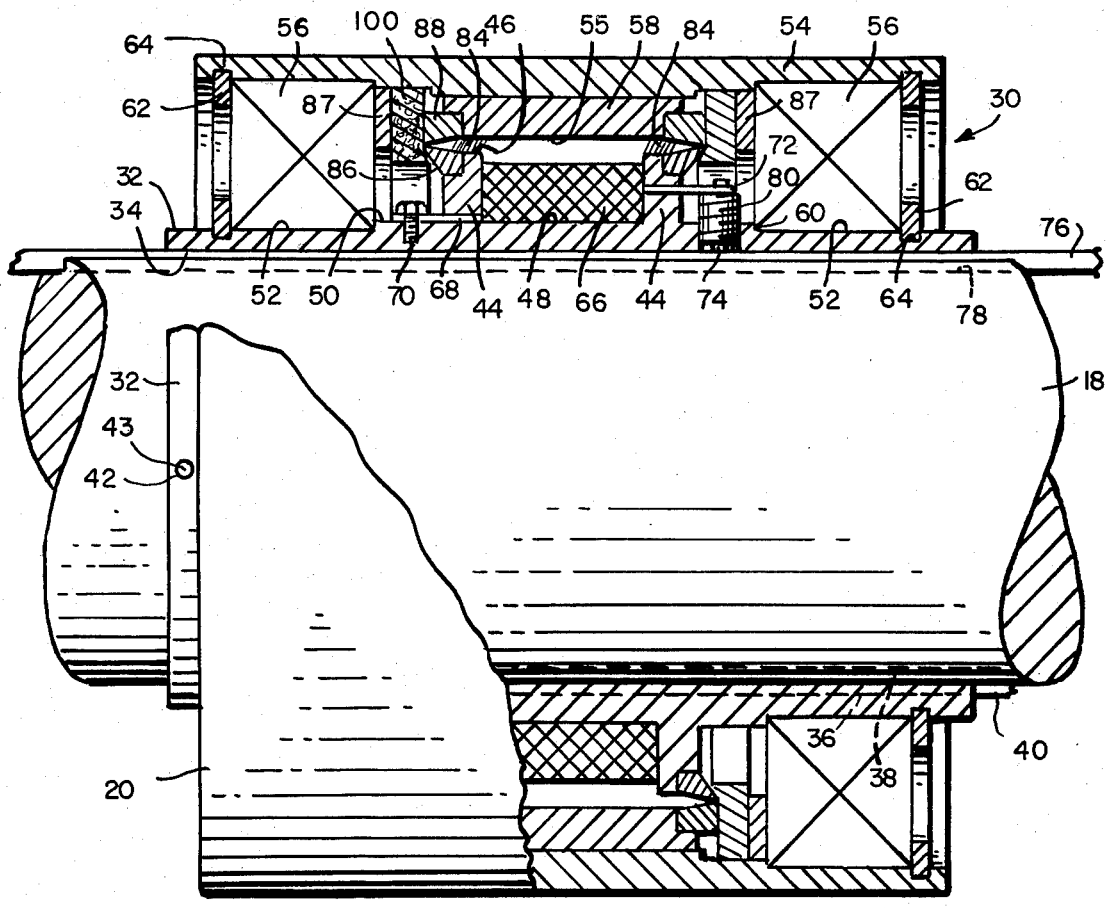
FIG. 2 is an enlarged elevation of the winding shaft showing the winding clutch in section.

In accordance with this invention, each core 20 is adapted to be variably clutched to one or the other of the drive shafts 18—18 by a clutch assembly 30, such as shown in FIG. 2, each clutch being independently controlled of every other clutch assembly so that the tension in each strip wound onto a core may be adjusted independently of that wound on any other core. To this end, there is shown in FIG. 2 and referring now to only one of the drive shafts 18, since both are alike and all of the clutches are alike, there is mounted on the drive shaft 18 an inner part 32 which is in the form of a sleeve having an inside diameter 34 of such dimension that it slidably fits onto the shaft 18. The sleeve and shaft are provided with keyways 36, 38 and a key 40 is mounted in the keyways so as to cause the sleeve to rotate with the shaft and yet to enable the sleeve to be moved longitudinally on the shaft. It is desirable to be able to space the clutch assemblies 30 along the shaft at fixed positions and so threaded openings 42 are provided in the sleeve and set screws 43 are screwed into these against the shaft 18.

The sleeve 32 has intermediate its opposite end axially spaced, radially extending flanges 44—44 having peripheral surfaces 46—46 and between these flanges 44—44 there is an annular recess 48. Outwardly of the flanges 44—44 there are axially extending circumferential stepped lands 50—50 and 52—52. An outer part 54 is mounted about the inner part in concentric relation thereto and for rotation relative thereto on bearing numbers 56—56 which are mounted on the landed portion 52—52 of the inner part. The outer part 54 is in the form of a sleeve and has secured to its inner side in opposing relation to the peripheral surfaces of the flanges 46—46, a cylindrical core 58, the axial length of which corresponds to the axial distance between the outer side of the flanges 44—44. The core 58 may, for example, be sweated into the sleeve 54 and has a peripheral surface 55. The bearings 56—56 are held in axially fixed relation by shoulders 60—60 at the junction of the lands 50—50 and 52—52 and by spring rings 62—62 set into grooves 64—64, thus holding the inner and outer sleeve in axially fixed relation to each other.

A coil 66 of copper wire covered with suitable insulation in wound about the inner part within the recess 48 with one end grounded by means of a lead 68 and screw bolt 70 to the inner part and the other end connected by a lead 72 and spring pressed pin 74 to a bus bar 76 set into a groove 78 in the shaft 18. The pin 74 is insulated from the inner part 52 by means of a nonmetallic insulating sleeve 80. Preferably, the pin 74 has a gold-plated tip for engagement with the bus bar. A single bus bar 76 may be used for all of the clutch assemblies on the shaft and may be provided at the position of each assembly with an enlarged area for engagement of the pin 74 therewith or a plurality of wires may be led along the grooves 78 and at the position of each clutch assembly provided with an enlarged terminal area for engagement with a pin 74. Commutators C in the form of a slip ring assembly are provided for making the electrical connection to the rotary shafts. Optionally, a printed circuit may be employed.

The peripheral surfaces 46—46 of the flanges provide in conjunction with the peripheral surface 55 of the core 58 poles between which there are working gaps 84—84 which are adapted to be bridged by magnetized particles of magnetizable material which are held in the working gaps when the core is energized. The gaps are in the order of ⅛ inch. The magnetized particles by bridging the gaps provide a driving torque between the inner part and the outer part which may be varied by increasing or decreasing the current flow through the coil and is preferably a powdered material. A very small particle size is employed to provide for the bridging. The current which passes through the several coils is controlled by separate current controlling devices, one for each assembly, for example, a potentiometer P or other variable resistant member. The current delivered to the entire number of clutch assemblies may also be controlled by a master potentiometer MP or the like.

Figure 3:
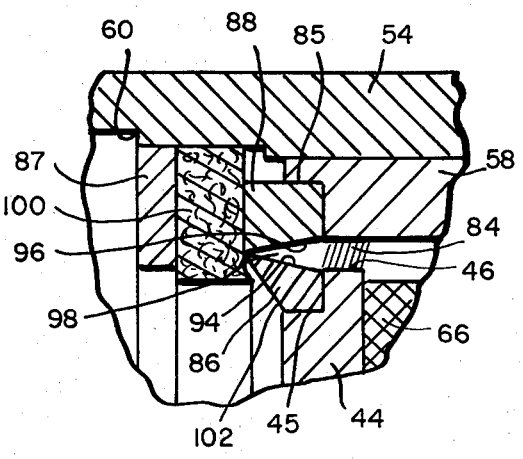
FIG. 3 is a fragmentary section of one form of sealing means used in the clutch.
Figure 4:
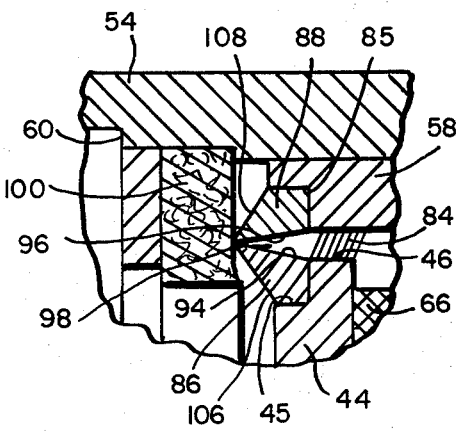
FIG. 4 is a fragmentary section of another form of sealing means used in the clutch.
Figure 5:
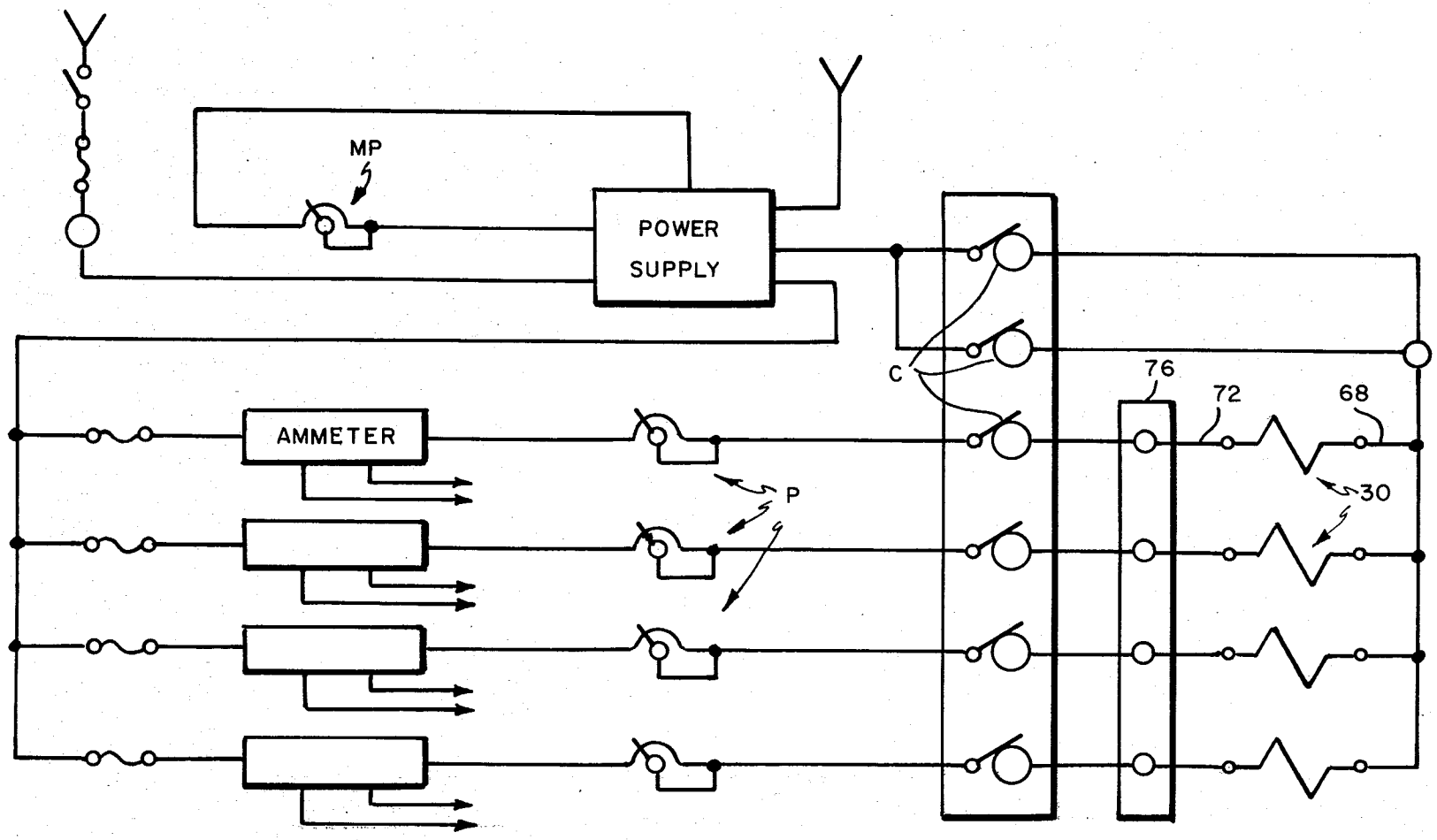
FIG. 5 is the wiring diagram.

In accordance with this invention, in order to control the magnetized particles, that is, to keep them in the working gaps and to minimize their escape sealing rings 86—86 and 88—88 are recessed into the outer sides of the flanges 44—44 and the opposite ends of the core 58. The flanges 44—44 are provided with right angular grooves 45—45 for receiving the sealing rings 86—86 and the ends of the core 58 are provided with right angular grooves 85—85 for receiving the sealing rings 88—88. The rings 86—86 and 88—88 have inner sides 94—94, 96—96 which slope respectively outwardly and radially inwardly relative to the axis of rotation of the shaft 18 so that they converge towards each other at their outer sides, thus providing gradually narrowing gaps 98—98 which tends to exclude the particulate material The sloping surfaces do not touch since it is not desirable that they shall be in frictional engagement with each other. The relatively small gaps at the outer sides between the surfaces 94—94, 96—96 are closed by sealing strips 100—100 supported on the inner side of the outer part 54. The strips are held engaged with the outer sides of the sealing rings 88—88, by backing rings 87—87 and in one form as shown in FIG. 3, the sealing rings 86—86 have inclined surfaces 102—102 at their outer sides so that they have substantially line contact with the strips, thus reducing the rubbing friction between the strips and the sealing rings 86—86. FIG. 4 shows a modification in which both of the sealing rings 86—86 and 88—88 have inclined outer sides 106-108 which converge so that both rings have substantially line contact with the strips. The beveled edges of the sealing rings tend to wear into the strips, thus enhancing the sealing.

The inner part or sleeve 32 is comprised of hard steel, the coil 66 is comprised of insulated copper wire, the outer part or sleeve 54 is comprised of a nonmagnetic material and the core 58 is comprised of hard steel. When the magnetizable particles (powder) are magnetized by a flow of current through the coil, the particulate material which is a magnetic medium bridges the working gaps between the surfaces 46—46 of the flanges 44—44 and the surface 55 of the core 58 providing a driving connection and, as indicated above, the torque or driving force which may be applied through these particles in the working gaps depends upon the magnetic flux in the working gap which, in turn, depends upon the flow of current in the coil and this may be adjusted for each clutch assembly by means of the potentiometer associated with it.

The sealing rings 86—86 and 88—88 are comprised of a nonmagnetic material, for example, aluminum and so the magnetization produced between the working surface tends to draw any particles which tend to migrate to be drawn from between the converging surfaces of the sealing rings into the sphere of action of the working surfaces, thereby making for a maximum use of the particles, by concentrating them in the area where they are most effective and thus providing for the most uniform application of the torque between the inner and outer parts. By narrowing the sealing rings down at their sides where they have contact with the sealing strips, their frictional engagement with the sealing strips may be kept to a minimum. The sealing strips are comprised, for example, of felt.

The outer parts or sleeves 54 are adapted to receive and to have secured thereto the cores upon which the strips are to be wound.

The drive shafts 18—18 are driven at a constant speed and in using the apparatus, the master potentiometer MP is adjusted to provide the desired flow of current and the individual potentiometer P are adjusted to provide for current flow through each clutch assembly according to the tension desired. Since the tension is a function of torque divided by the radius of the package being wound, if it is desirable to maintain a constant tension throughout the entire buildup of the package, the torque must be increased as the radius increases and this can be easily accomplished with this apparatus by increasing the current flow through the coils since the torque is directly proportional to the current flow. It may be desirable to increase the tension somewhat as the package increases in size to prevent the outside convolutions from being wound too loosely since if torque remains constant, then the tension decreases as OD increases, thus on large rolls of elastic material control torque is desirable, or to vary the tension from package to package because of differences in width or thickness of the strips and this, too, can be easily accomplished with this apparatus by adjusting the current flow through the several assemblies. Still another advantage that flows from this arrangement resides in the fact that since the torque remains constant for changes in rotation of the drive shafts 18—18, it is possible to slow down rotation of these shafts in successive jumps without in any way affecting the tension, thereby avoiding the necessity for elaborate controls which are characteristic of the prior art and which are used to control heating in the clutch assemblies to avoid changes in torque. Other advantages reside in the ease of conversion to existing systems, accurate control of the torque, ease of removing and replacement of core and/or clutch assemblies which reduces down time, individual adjustment to compensate for wear, maximum flexibility of operation, and cleanliness of operation since no external friction dust is generated as in prior art pneumatic end load devices which rely on core and keyed to shaft space arrangements.

Thus, a very simple piece of equipment is provided for winding strips of material of various widths and varying degrees of thickness by the simple expedient of mechanically measuring the diameter on the tension at any given moment and then adjusting the potentiometers controlling the current flow through the clutch assemblies to provide the desired tension.

It should be understood that the present disclosure is for the purpose of illustration only and includes all modifications or improvements which fall within the scope of the appended claims.

I claim:

1. In a winding machine for winding a plurality of packages simultaneously, a drive shaft for receiving a plurality of cores and a clutch for clutching each core to the shaft comprising concentrically arranged inner and outer parts mounted on the shaft with the inner part fixed to the shaft and the outer part rotatably supported on the inner part by bearings for rotation relative to the inner part, said parts having at their outer and inner sides, respectively, radially protruding surfaces of predetermined axial length defining annular working gaps between the parts, particulate magnetizable material situated in the working gaps, means for magnetizing the particular material in the working gaps and means for confining the particulate material in the working gaps comprising nonmagnetizable sealing rings at the ends of the radially protruding surfaces having opposed surfaces which define closure gaps at the ends of the working gaps which converge axially outwardly of the working gaps and resilient sealing strips supported for engagement with the outer sides of the sealing rings across the closure gaps.

2. Apparatus according to claim 1 wherein the means for magnetizing the particulate material is recessed into the inner part.

3. Apparatus according to claim 1 wherein the inner parts contain an annular recess and the means for magnetizing the particular material is a coil supported in the recess, grounded at one end to the inner part and electrically connected at its other end through an insulator to a conductor extending along the shaft.

4. Apparatus according to claim 1 wherein the sealing rings are recessed into the ends of the protruding surfaces.

5. Apparatus according to claim 1 wherein the sealing rings are nonmagnetic.

6. Apparatus according to claim 1 wherein the sealing strips are fibrous.

7. Apparatus according to claim 1 wherein the outer sides of the sealing rings are beveled so as to have minimal engagement with the sealing strips.

8. In a winding machine for winding a plurality of packages simultaneously, a winding shaft for receiving a plurality of cores, a clutch for clutching each winding core to the winding shaft comprising concentrically arranged inner and outer parts, means for securing the inner part to the shaft for rotation therewith, bearings on the inner part mounting the outer part thereon for rotation relative to the inner part, axially spaced radially protruding surfaces on the inner part, defining an annular recess therebetween, a radially protruding core on the outer part corresponding in axial length to the distance between the outer sides of the radially protruding surfaces on the inner part, said axially spaced radial surfaces on the inner part and the opposed surface of the core on the outer part defining working gaps, a coil wound onto the inner part in the annular recess, a quantity of particulate magnetizable material in the recess and means for retaining the particulate material within the working gaps comprising nonmagnetizable rings recessed into the outer sides of the protruding surfaces in concentric relation to each other with closure gaps therebetween which decrease from the inner sides of the rings toward the outer sides and sealing strips held engaged with the outer sides of the rings across the gaps therebetween.

9. Apparatus according to claim 8 wherein a bus bar is recessed into the shaft and extends axially therealong and there are means grounding the coils to the inner part and connecting the coils to the bus bar.

10. Apparatus according to claim 9 wherein the latter means comprises insulators mounted in openings in the inner parts in communication with the bus bar and spring pressed contacts yieldably supported in the insulators and electrically connected to the coils.

11. Apparatus according to claim 1 wherein the inner and outer parts contain annular recesses for receiving the bearing assemblies.

12. Apparatus according to claim 1 wherein the particles of the particulate material are relatively small.

13. Apparatus according to claim 1 wherein the distance between the surfaces defining the working gaps is in the order of ⅛ inch.

14. In a winding machine for winding a plurality of packages simultaneously, a drive shaft for receiving a plurality of cores and a clutch for clutching each winding core to the shaft comprising concentrically arranged inner and outer parts, said inner part comprising an inner sleeve mounted on a shaft, for rotation therewith, and said outer part comprising an outer sleeve of larger inside diameter than the inner sleeve, bearing means mounting the outer sleeve on the inner sleeve for rotation relative thereto, axially spaced radially protruding flanges on the outer side of the inner sleeve providing relatively narrow circumferential surfaces between which there is an annular recess, an axially protruding cylindrical core providing a broad circumferential surface on the inner side of the outer sleeve corresponding in axial length to the axial distance between the outer side of the flanges, the surfaces of the flanges and the core defining annular working gaps, a coil disposed in the recess between the flanges, a particulate magnetizable material disposed in the recess about the coil and means for retaining the particulate material within the working gaps comprising sealing rings recessed into the outer sides and ends of the flanges and core, said rings having opposed clearance surfaces which converge outwardly and outer sides which are beveled and sealing strips held engaged with the beveled surfaces of the sealing rings across the sealing gaps therebetween.

15. Apparatus according to claim 14 wherein there are means for fixing the inner parts to the shaft.

16. Apparatus according to claim 14 wherein there is a bus bar recessed into the shaft and extending between the outer surfaces of the shaft and the inner surfaces of the inner parts and there are insulated connectors extending from the coils through the inner parts into engagement with the bus bar.

17. Apparatus according to claim 14 wherein the flanges are formed integral with the inner part and the core is affixed into the inner side of the outer part.

18. A winding apparatus comprising a shaft, winding cores disposed along the shaft, means for clutching each core to the shaft independently of the others, each means comprising an inner part adapted to be secured to the shaft for rotation therewith, an outer part adapted to be supported for rotation above the inner part, said outer part having a larger inside diameter than the inner part, bearing members supporting the outer part in concentric relation to the inner part, axially spaced radially extending flanges on the outer surface of the inner part between which there is an annular recess, an axially extending core protruding radially from the inner side of the outer part, the peripheral surfaces of the flanges and the core defining working gaps, a coil disposed in the annular recess, particulate magnetizable material disposed in the recess about the coil, means for retaining the particulate material in the working gaps, and means including a potentiometer connecting the coil of each clutch means to a power source.

19. A winding apparatus according to claim 18, comprising electrical conductors on the shaft extending therealong to each of the clutch means, and means connecting the coil of each clutch means to an electric conductor, and grounding each coil to the inner part to provide for current flow through the coil of each clutch means.

20. A winding apparatus comprising a shaft, winding cores disposed along the shaft, means for clutching each core to the shaft, comprising electromagnetic clutch assemblies mounted along the shaft one for each core each provided with a separate lead and current control device such that each can be adjusted independently of the other, each magnetic assembly comprising an inner part adapted to be fixed to the shaft for rotation therewith, an outer part, a bearing supporting the outer part in concentric relation to the inner part, said inner and outer parts having, respectively, outer and inner surfaces which define work gaps, magnetizable particulate material situated in the gaps, means embodied in the inner part for generating an electromagnetic field in the gaps between the surfaces, nonmagnetizable insulators outwardly of the respective ends of the surfaces defining sealing gaps which converge outwardly but do not touch and sealing strips held in engagement with said insulators across the gaps therebetween.

21. An apparatus according to claim 20 wherein the shaft and inner part contain keyways and there is a key disposed in said ways which causes the inner part to rotate with the shaft but permits axial movement of the inner part on the shaft.

22. An apparatus according to claim 20 wherein the inner and outer parts contain, respectively, peripheral grooves for receiving said bearings and means for preventing axial movement of said bearings.

23. An apparatus according to claim 22 wherein the means for preventing the axial movement of the bearings in said grooves comprise spring rings set into the outer part against the bearings.

24. In an apparatus for unwinding sheet material from a package, dividing it into narrow strips and rewinding the strips to form separately wound packages, a first shaft on which the package of sheet material is mounted, slitting means over which the sheet material is drawn for slitting it into narrow strips, a second shaft and means for rotating said second shaft, cores on the second shaft on which the narrow strips are to be wound, means on the first and second shafts for adjustably restraining rotation of the package relative to the first shaft and the cores relative to the second shaft, there being one such means associated with each core on the second shaft, means for effecting operation of each of said means independently of any other such means, and means for effecting adjustment of each of said means as the package increases in diameter to maintain predetermined tensions in the strips being wound on the cores.

25. Apparatus according to claim 24 wherein the means on the first shaft is a braking device which opposes rotation of the package thereon.

26. Apparatus according to claim 24 wherein the means on the second shaft for causing rotation of the cores with the second shaft is a clutching device for clutching the cores to the second shaft.

27. A winding apparatus comprising a shaft, winding cores disposed along the shaft, means for clutching each core to the shaft independently of the others comprising electromagnetic clutch assemblies mounted along the shaft, each provided with a separate lead and a current control device such that each can be adjusted independently of the others, each electromagnetic clutch comprising an inner part adapted to be fixed to the shaft for rotation therewith, an outer part, bearings supporting the outer part for rotation relative to the inner part, said inner and outer parts having, respectively, outer and inner surfaces which define working gaps, magnetizable material situated in the gaps, means embodied in the inner part for generating an electromagnetic field in the gaps between the surfaces, nonmagnetizable insulators outwardly of the respective ends of the surfaces defining sealing gaps which converge outwardly but do not touch and nonmetallic strips held in engagement with the insulators across the sealing gaps therebetween.

28. A winding apparatus comprising a winding shaft, winding cores disposed along the shaft, means for clutching each core to the shaft independently of the others, comprising magnetic clutch assemblies mounted along the shaft, and means providing each clutch assembly with a separate lead and current control device such that each can be adjusted independently of the others, each magnetic clutch comprising inner and outer concentrically arranged parts, means fixing the inner parts to the shaft, means rotatably supporting the outer parts on the inner parts for rotation relative thereto, poles on the respective parts between which there is a working gap, means for confining particulate magnetizable material in the working gaps, means for driving the shaft and means for producing a magnetic field between the poles for magnetizing the particulate material in the working gaps, said last means comprising a coil associated with one of the parts, means for supplying current to the coil and means for adjusting the current flow through the coil.

* * * * *